US012006954B2

(12) United States Patent
Shie

(10) Patent No.: US 12,006,954 B2
(45) Date of Patent: Jun. 11, 2024

(54) FILTERING DEVICE FOR FAN

(71) Applicant: CLUCH ENTERPRISE CO., LTD, Tainan (TW)

(72) Inventor: Cheng-Yi Shie, Tainan (TW)

(73) Assignee: CLUCH ENTERPRISE CO., LTD, Tainan (TW)

( * ) Notice: Subject to any disclaimer, the term of this patent is extended or adjusted under 35 U.S.C. 154(b) by 0 days.

(21) Appl. No.: 18/331,278

(22) Filed: Jun. 8, 2023

(65) Prior Publication Data

US 2024/0011507 A1 Jan. 11, 2024

(30) Foreign Application Priority Data

Jul. 5, 2022 (TW) ..... 111207133

(51) Int. Cl.
*F04D 29/70* (2006.01)
*F04D 29/52* (2006.01)

(52) U.S. Cl.
CPC ..... *F04D 29/703* (2013.01); *F04D 29/522* (2013.01)

(58) Field of Classification Search
CPC ..... F04D 29/703; F04D 29/522; F04D 25/12; F04D 29/646; F04D 19/002
See application file for complete search history.

(56) References Cited

U.S. PATENT DOCUMENTS 4,477,272 A * 10/1984 Hollis ..... F24F 13/28 D23/370
5,888,261 A * 3/1999 Fortune ..... F04D 29/703 55/467
5,988,108 A * 11/1999 Silver ..... A01K 1/0052 119/166
6,398,835 B1 * 6/2002 Rehil ..... B01D 46/10 55/471
2014/0141708 A1 * 5/2014 Baker ..... F04D 29/703 417/423.15

* cited by examiner

*Primary Examiner* — Courtney D Heinle
*Assistant Examiner* — Andrew Thanh Bui
(74) *Attorney, Agent, or Firm* — Best & Flanagan LLP

(57) ABSTRACT

A filtering device is adapted to be mounted in a fan having a motor cover, a rotary shaft, an impeller combined at the rotary shaft, and a rear protective grill mounting on a mounting base provided on a front end of the motor cover. The filtering device includes an inner ring plate, an outer ring plate, and a filter element. The filter element is sandwiched between the inner ring plate and the outer ring plate, and the inner ring plate and the outer ring plate are coupled between the rear protective grill and the rear protective grill lock ring. The airflow sent out by the rotation of the impeller of the fan will pass through the filter element of the filtering device, achieving the effect of purifying air.

9 Claims, 10 Drawing Sheets

FILTERING DEVICE FOR FAN

BACKGROUND OF THE INVENTION

1. Field of the Invention

The present invention relates to a fan filtering device and, more particularly, to a filtering device adapted to be installed in a fan to purify the air.

2. Description of the Related Art

In addition to the air conditioner, the fan is one of the necessary household appliances in summer, so as to achieve the effects of cooling and heat dissipation. The fan mainly utilizes the rotation of the impeller to accelerate the circulation of air. However, the air in the living environment usually contains particles and dust, and therefore, when the quality of the surrounding air is not good, the quality of the airflow sent by the fan is poor, and the dust will adhere to the protective grill and the impeller.

In the conventional technology, there is a fan filter used to be installed on the fan, so that the fan has the effect of purifying the air. However, the price of the fan filter is expensive, resulting in the consumer lacking the willingness to purchase.

BRIEF SUMMARY OF THE INVENTION

Thus, an objective of the present invention is to provide a filtering device for a fan, which is adapted to be installed in the fan, so that the fan has the effect of purifying air, and the filtering device has the advantages of simple structure, convenient installation and low price.

To achieve this and other objectives, a filtering device for a fan according to an embodiment of the present invention is adapted to be installed in the fan. The fan is provided with a motor cover, a rotary shaft, an impeller combined at the rotary shaft, and a rear protective grill mounting on a mounting base provided on a front end of the motor cover. A rear protective grill lock ring is locked on the mounting base to fix the rear protective grill. The filtering device includes an inner ring plate, an outer ring plate and a filter element. The inner ring plate has a first outer ring portion, a first inner ring portion, and a plurality of first connection portions connected between an inner periphery of the first outer ring portion and an outer periphery of the first inner ring portion. The plurality of first connection portions are spaced along a peripheral direction of the inner ring plate. The first inner ring portion is provided with a support portion therein, and the support portion has a first shaft hole therein through which the mounting base extends. The outer ring plate has a second outer ring portion, a second inner ring portion, and a plurality of second connection portions connected between an inner periphery of the second outer ring portion and an outer periphery of the second inner ring portion. The plurality of second connection portions are spaced along a peripheral direction of the outer ring plate. The second inner ring portion is provided with a second shaft hole therein. The inner periphery of the second inner ring portion is provided with a plurality of fixing pieces extending toward the second shaft hole and spaced along a peripheral direction of the second inner ring portion. The filter element is coupled between the inner ring plate and the outer ring plate and includes a through-hole therein. The first shaft hole, the through-hole and the second shaft hole are aligned in an axial direction of the rotary shaft. The rotating shaft is adapted to extend through the first shaft hole, the through-hole and the second shaft hole. The fixing piece of the outer ring plate extends in the through-hole of the filter element and is attached to the support portion of the inner ring plate, so that the support portion of the inner ring plate and the plurality of fixing pieces of the outer ring plate is fixed between the rear protective grill and the rear protective grill lock ring.

In a preferred form, the first inner ring portion of the inner ring plate is provided with an annular convex portion having a U-shaped section. The convex portion of the inner ring plate is sleeved in the through-hole of the filter element, and the plurality of fixing pieces of the outer ring plate are fitted in the convex portion of the inner ring plate.

In a preferred form, the fixing piece is L-shaped and includes a first section and a second section. The first section extends along the axial direction of the rotary shaft, and the second section extends along a radial direction of the outer ring plate and is attached to the support portion of the inner ring plate.

In a preferred form, the first outer ring portion of the inner ring plate and the second outer ring portion of the outer ring plate are combined with the filter element by bonding or adhesion.

In a preferred form, a first peripheral edge extends inwardly from the first outer ring portion of the inner ring plate, and a second peripheral edge extends outward from the second outer ring portion of the outer ring plate. The second peripheral edge of the outer ring plate and the first peripheral edge of the inner ring plate are attached on an outer peripheral edge of the filter element.

In a preferred form, a plurality of grooves are formed in the first peripheral edge, and a plurality of protrusions are arranged on the second peripheral edge and combined with the plurality of grooves of the inner ring plate.

In a preferred form, the filter element is a non-woven fabric filter material containing silver ions.

In a preferred form, the filter element is provided with a plurality of pleated filter portions in an annular configuration.

In a preferred form, the inner and outer ring plates are respectively formed of plastic plates.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where:

FIG. 3(*b*) shows an enlarged schematic view of the bending mode of fixing pieces of the filtering device of FIG. 1.

DETAILED DESCRIPTION OF THE INVENTION

Figure 1:
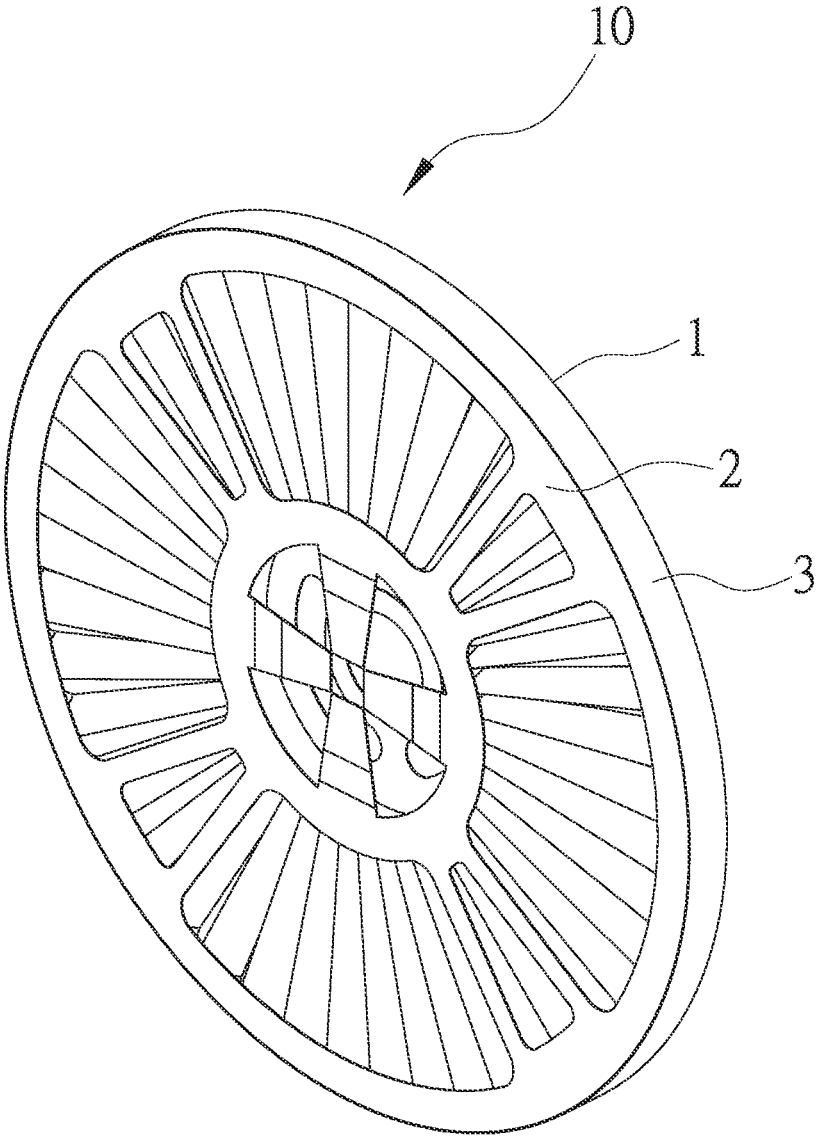
FIG. 1 is a perspective view of a filtering device for a fan in accordance with a first embodiment of the present invention.
Figure 2:
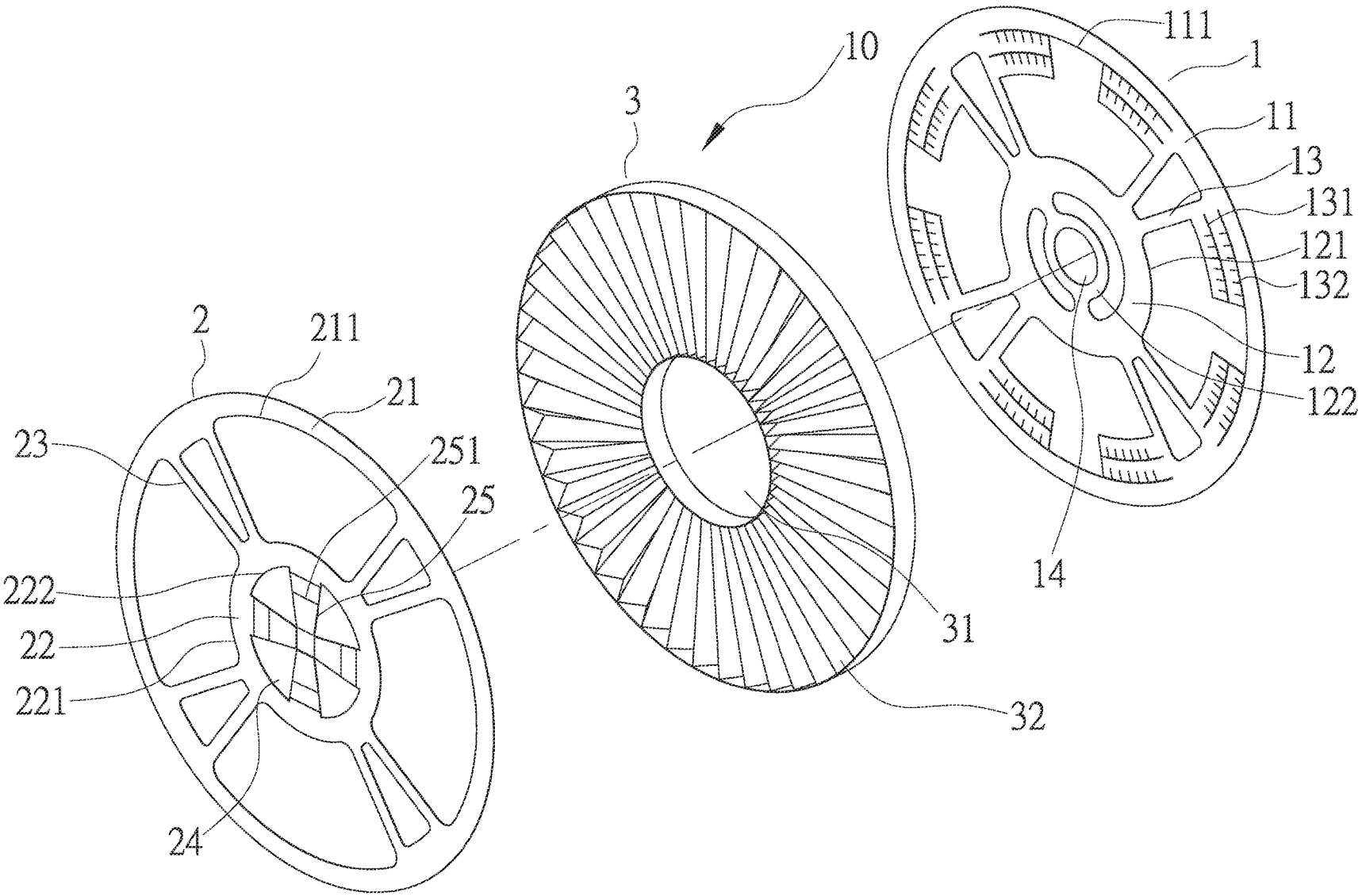
FIG. 2 shows an exploded view of the filtering device of FIG. 1.

A filtering device 10 according to a first embodiment of the present invention is shown in FIGS. 1 through 6 of the drawings and is applied to a fan 4. The fan 4 has a motor cover 40, a rotary shaft 42 coupled to a motor (not shown) inside the motor cover a set of fan blades or an impeller 41, and a rear protective grill 44. A mounting base 46 is provided on a front end of the motor cover 40 for mounting the rear protective grill 44. After the rear protective grill 44 is mounted on the mounting base 46, a rear protective grill lock ring 43 is locked on the mounting base 46 to fix the rear protective grill 44. The impeller 41 is combined at the front section of the rotary shaft 42, and a front protective grill 45 is combined with the rear protective grill 44, so that the impeller (the fan blades) 41 is located between the front protective grill 45 and the rear protective grill 44.

Figure 6:
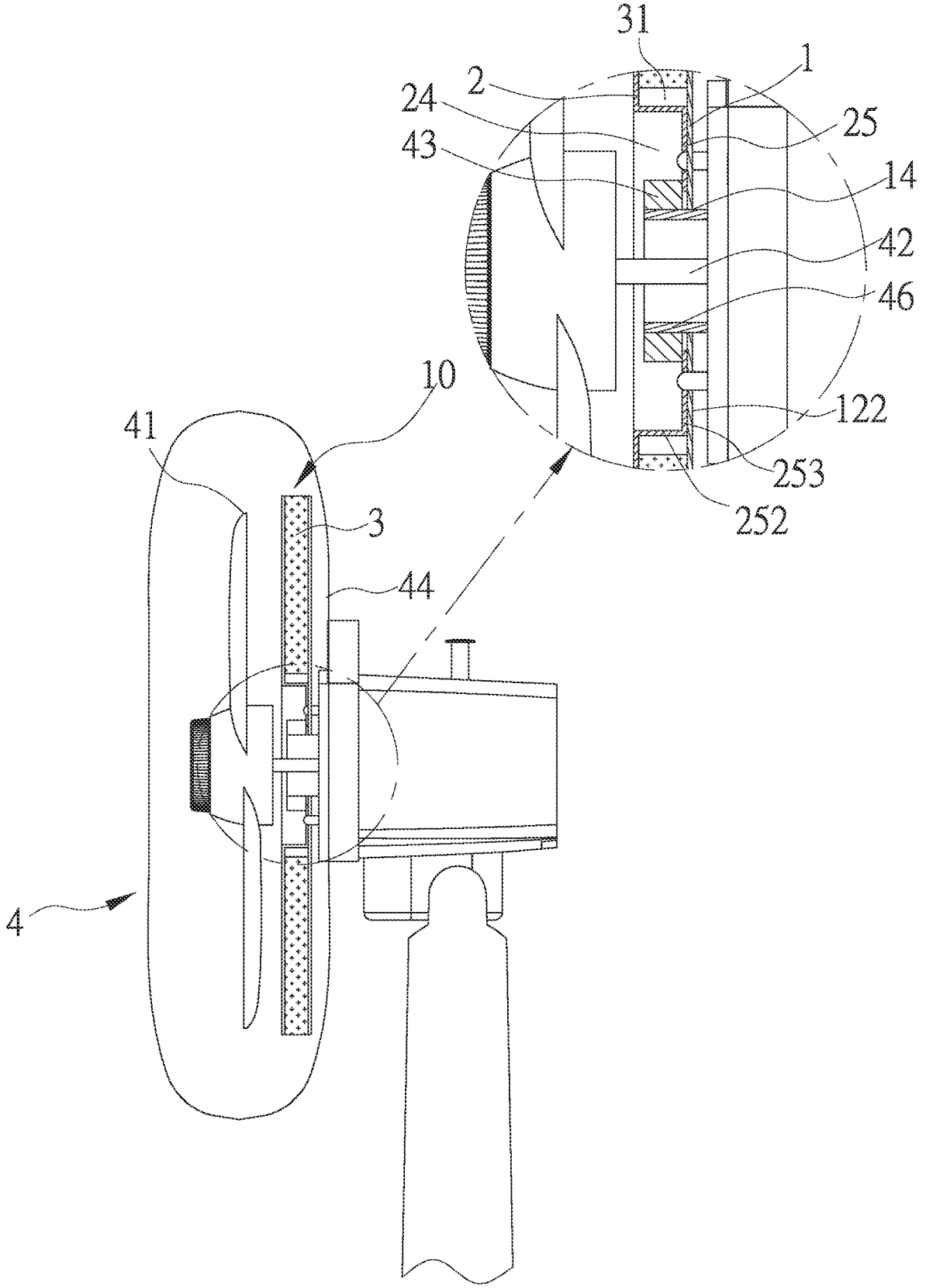
FIG. 6 shows a schematic cross-sectional view of the filtering device of FIG. 1 assembled in the fan of FIG. 4.
Figure 7:
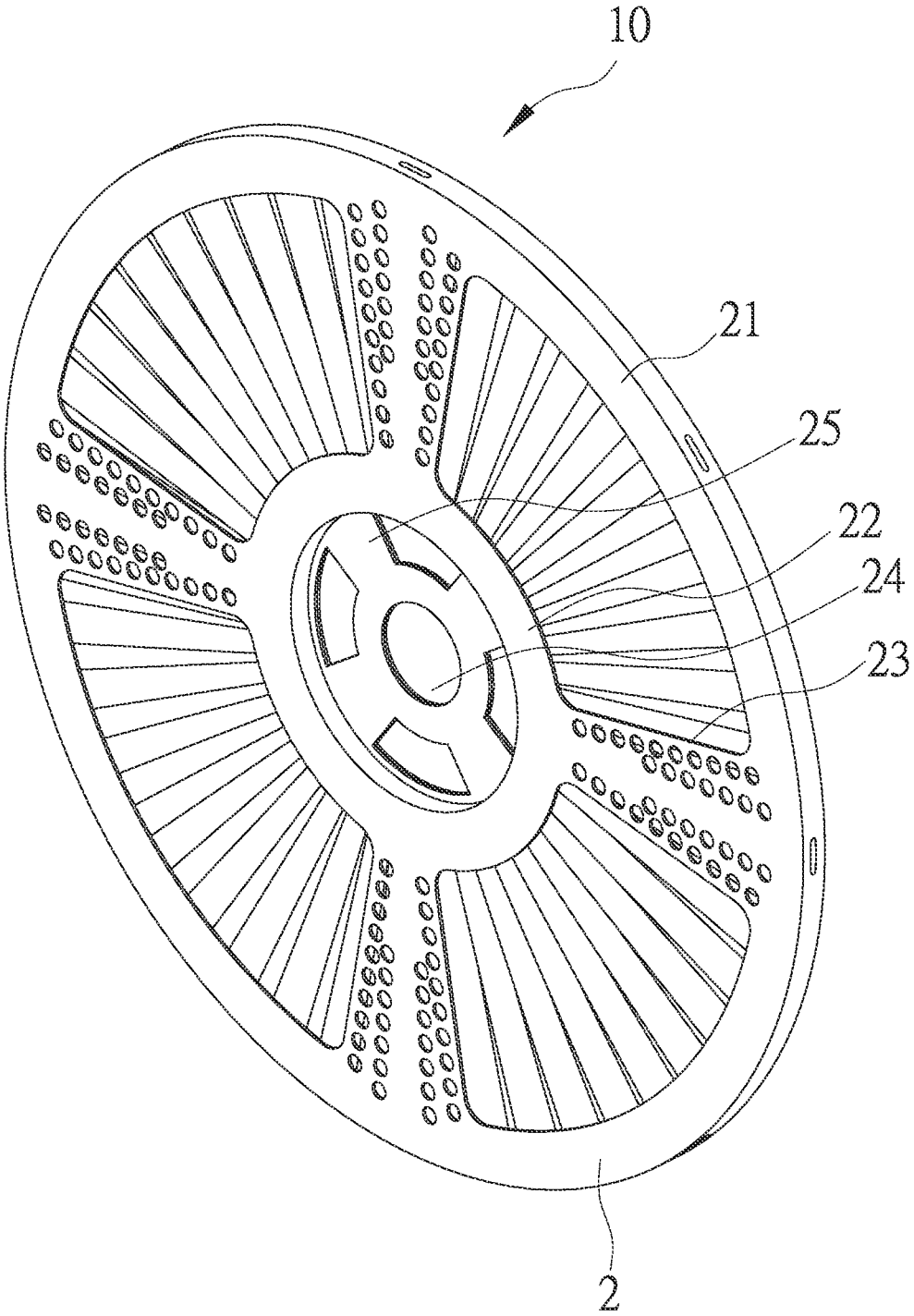
FIG. 7 is a perspective view of a filtering device for a fan in accordance with a second embodiment of the present invention.
Figure 8:
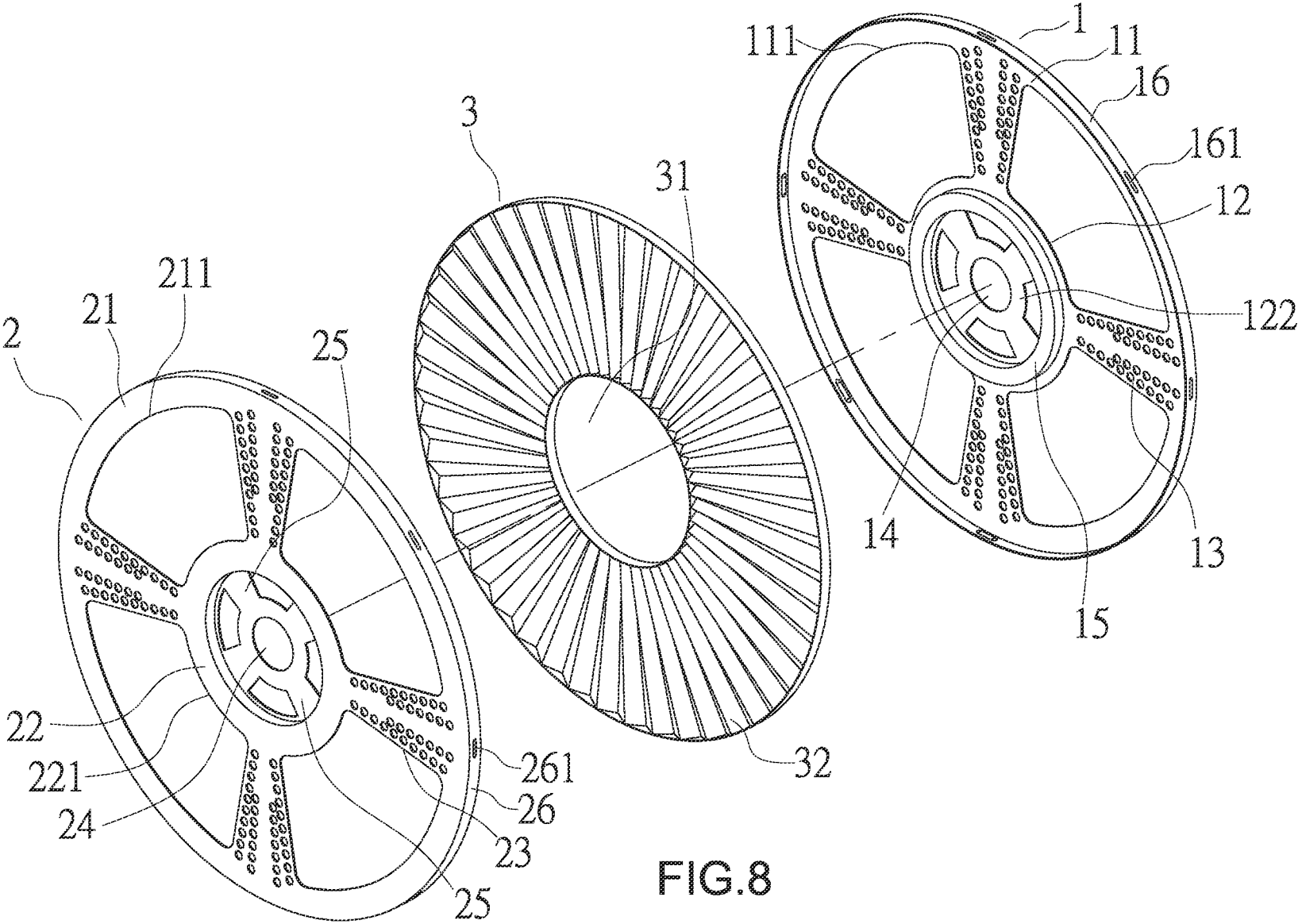
FIG. 8 shows an exploded view of the filtering device of FIG. 7.
Figure 9:
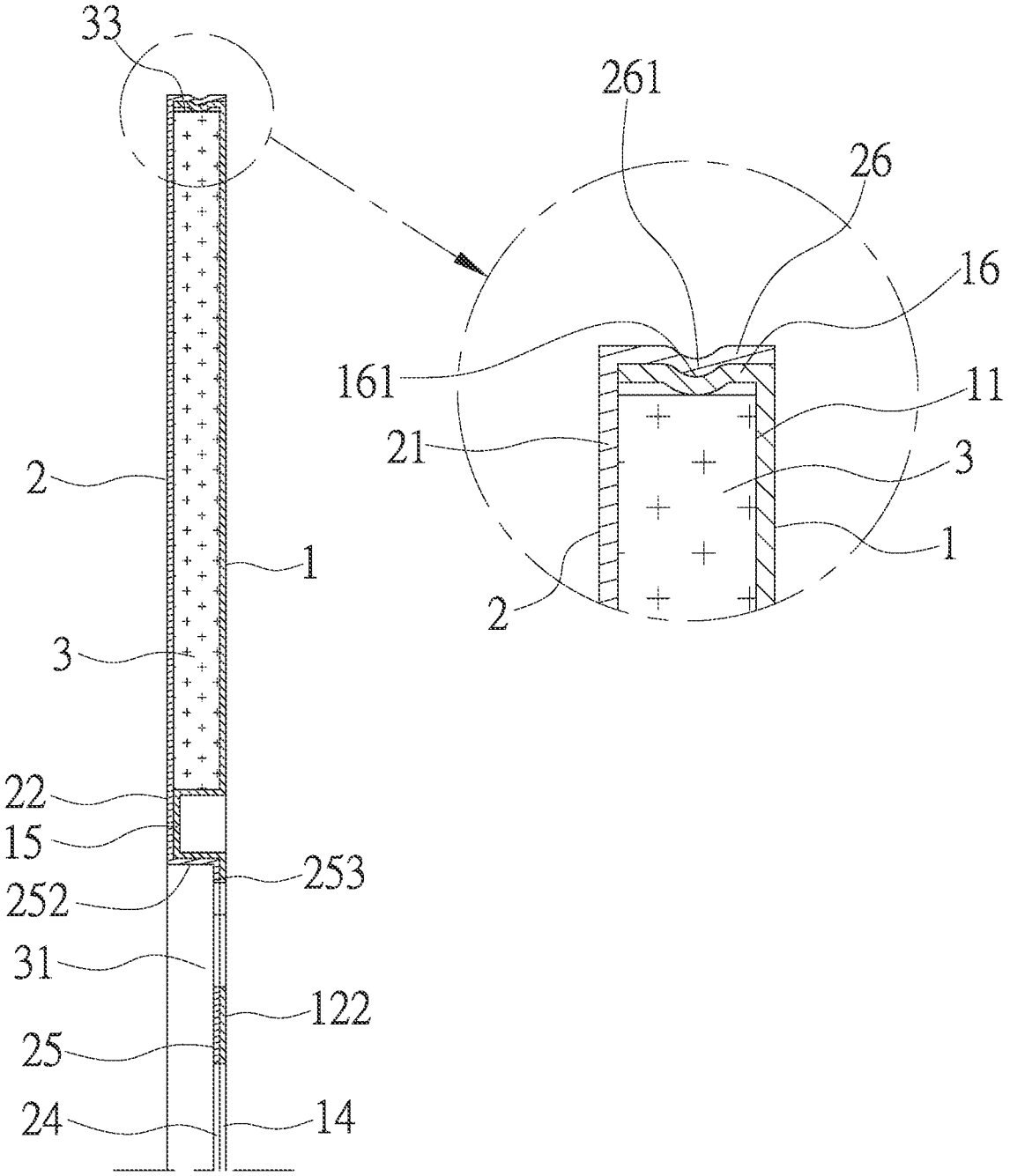
FIG. 9 shows a partially cross-sectional view of the filtering device of FIG. 7.
Figure 10:
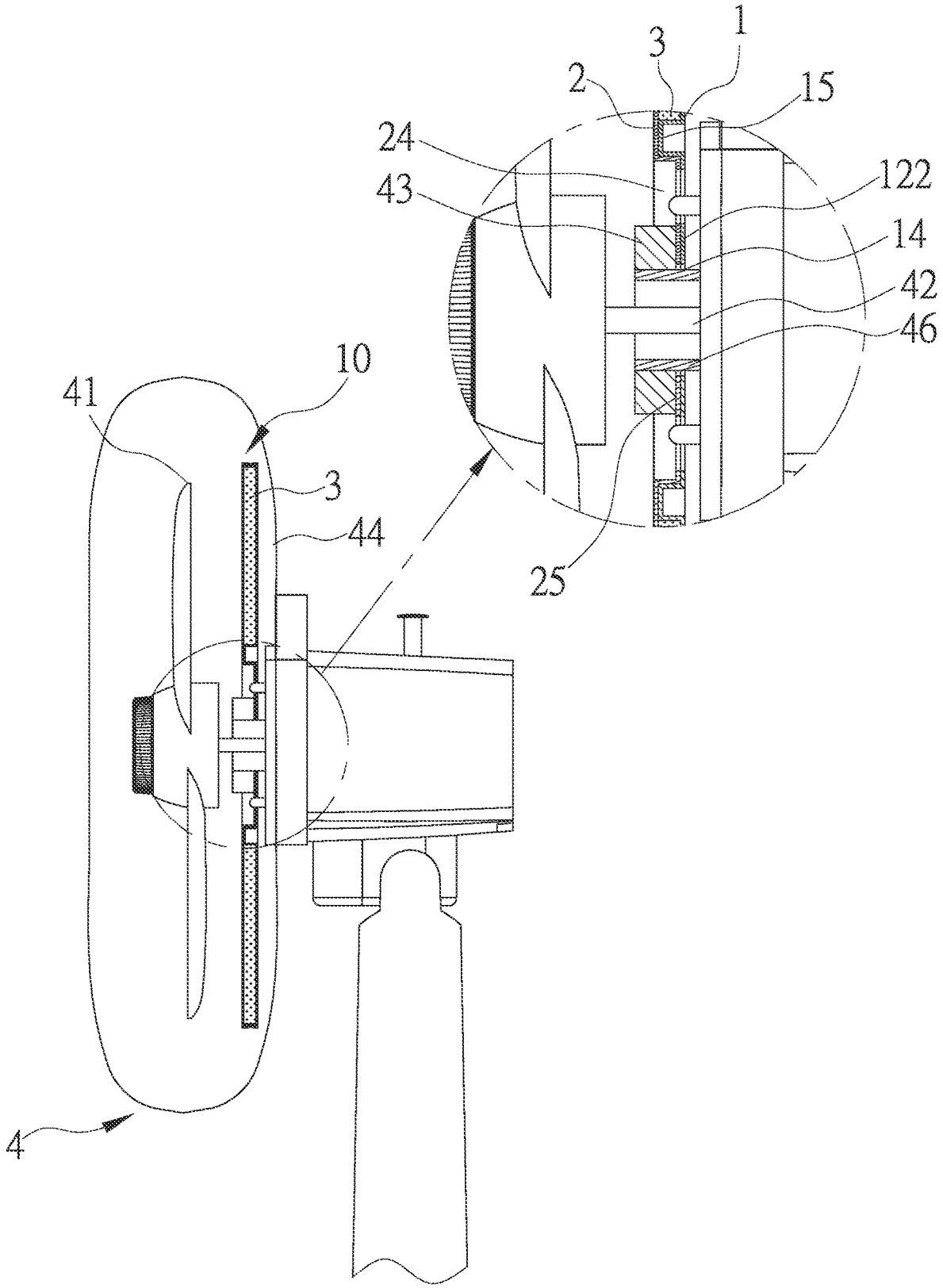
FIG. 10 shows a schematic cross-sectional view of the filtering device of FIG. 7 assembled in the fan of FIG. 4.

The filtering device 10 of the present invention is mounted between the rear protective grill 44 and the impeller 41 and includes an inner ring plate 1, an outer ring plate 2, and a filter element 3. The inner ring plate 1 has a first outer ring portion 11, a first inner ring portion 12, and a plurality of first connection portions 13 connected between an inner periphery 111 of the first outer ring portion 11 and an outer periphery 121 of the first inner ring portion 12. The plurality of first connection portions 13 are spaced along a peripheral direction of the inner ring plate 1. Furthermore, the center of the first inner ring portion 12 is provided with a support portion 122, and a first shaft hole 14 is provided in the support portion 122. The aperture diameter of the first shaft hole 14 is approximately equal to or slightly larger than the outer diameter of the mounting base 46, so that the support portion 122 of the inner ring plate 1 can be sleeved on the mounting base 46, as shown in FIG. 6. In a feasible embodiment, the inner ring plate 1 is formed of hard paperboards or cardboards, and at least one fixing strip 131 extends outwards from both sides of each first connection portion 13 adjacent to the inner periphery 111 of the first outer ring portion 11. The fixing strip 131 is bendable (see FIG. 3(*a*)) and is provided with a plurality of cutting lines 132. In another specific embodiment, the inner ring plate 1 is formed by a plastic plate. In the embodiment in which the inner ring plate 1 is made of a plastic plate, the inner ring plate 1 does not need to be provided with fixing strips 131.

Figure 3B:
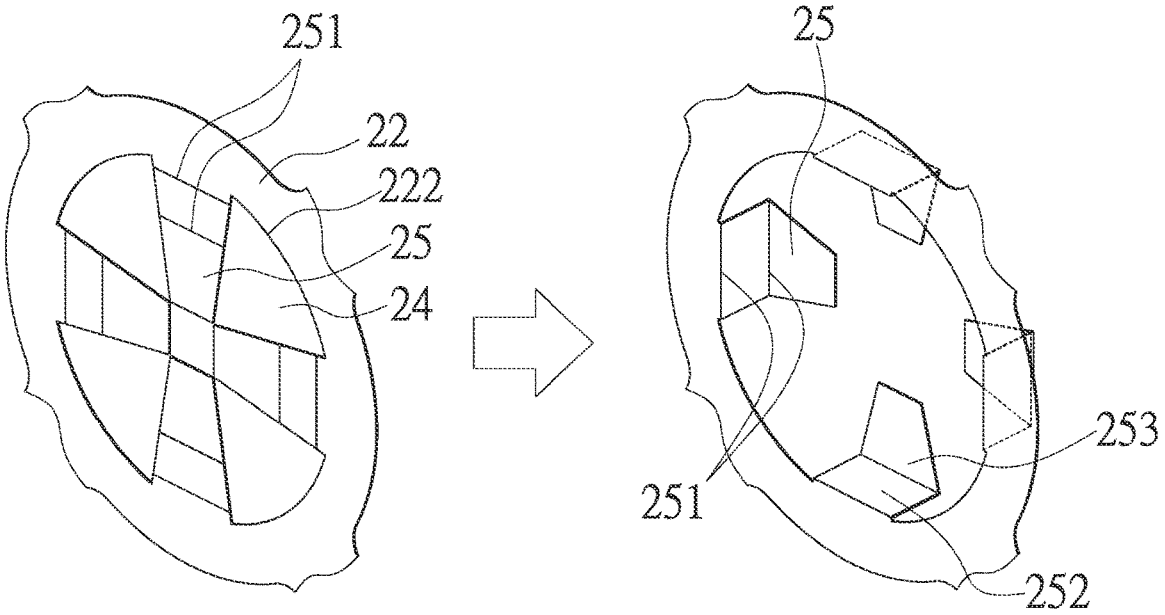
FIG. 3(*a*) shows a partial enlarged schematic view of the bending mode of fixing strips of the filtering device of FIG. 1.
Figure 3A:
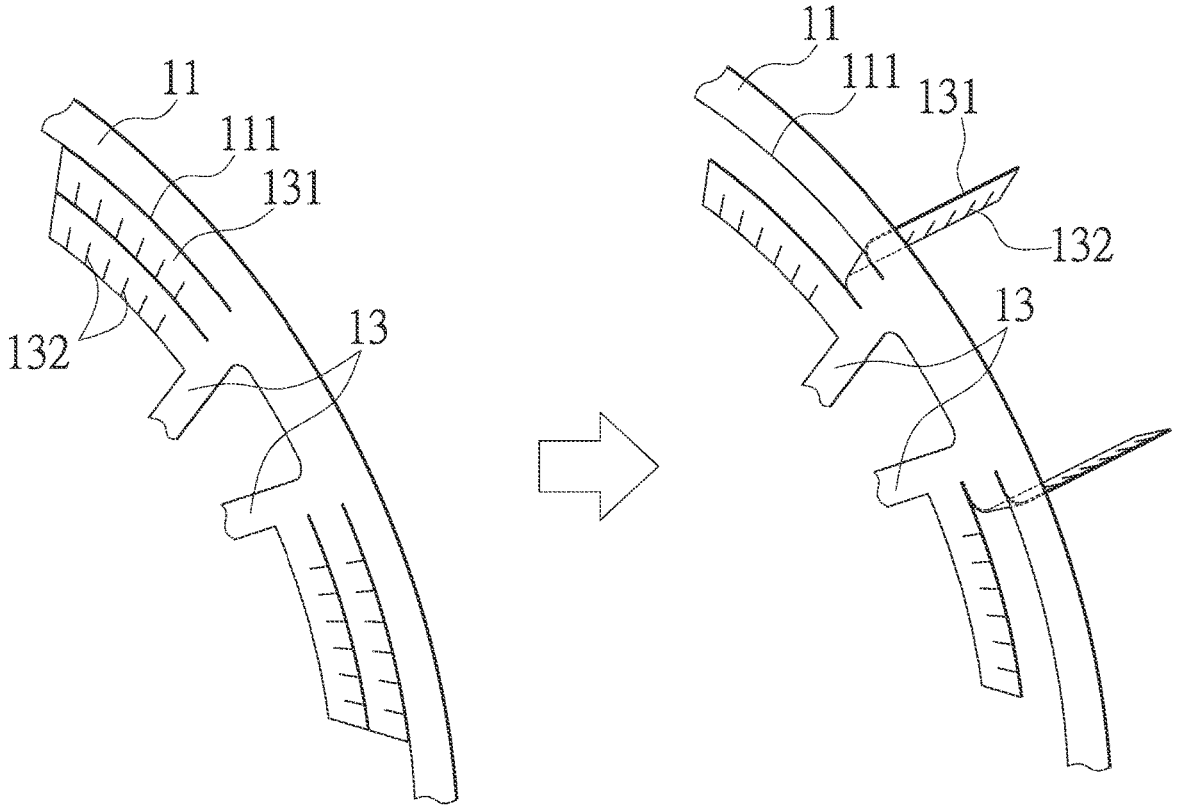

The outer ring plate 2 has a second outer ring portion 21, a second inner ring portion 22, and a plurality of second connection portions 23 connected between an inner periphery 211 of the second outer ring portion 21 and an outer periphery 221 of the second inner ring portion 22. The plurality of second connection portions 23 are spaced along a peripheral direction of the outer ring plate 2. The center of the second inner ring portion 22 is provided with a second shaft hole 24. The inner periphery 222 of the second inner ring portion 22 is provided with a plurality of fixing pieces 25 extending toward the second shaft hole 24 and spaced along a peripheral direction of the second inner ring portion 22. The fixing piece 25 is L-shaped and includes a first section 252 and a second section 253. The first section 252 extends along the axial direction of the rotary shaft 42, and the second section 253 extends along the radial direction of the outer ring plate 2, as shown in FIG. 6. In a feasible embodiment, the outer ring plate 2 is formed of hard paperboards or cardboards, and each fixing piece 25 is bendable and provided with at least one bend line 251. In this embodiment, each fixing piece 25 is provided with two spaced bend lines 251, so that the fixing piece 25 is bent into an L shape and includes the first section 252 and the second section 253, as shown in FIG. 3. In another specific embodiment, the outer ring plate 2 is formed by a plastic plate, and the fixing pieces 25 are integrally formed on the inner periphery 222 of the second inner ring portion 22.

The filter element 3 is sandwiched between the inner and outer ring plates 1 and 2, and the center of the filter element 3 is provided with a through-hole 31 whose aperture diameter is slightly larger than the aperture diameter of the second shaft hole 24. In this embodiment, the inner ring plate 1, the outer ring plate 2 and the filter element 3 respectively form a ring shape and have approximately equal sizes. The filter element 3 is made of a material that can filter suspended particles in the air and/or have a deodorizing function, such as but not limited to filter paper or a non-woven fabric. The filter element 3 is coupled between the inner and outer ring plates 1 and 2, and the first shaft hole 14, the through-hole 31 and the second shaft hole 24 are aligned in the axial direction of the rotary shaft 42. The fixing pieces 25 of the outer ring plate 2 are located in the through-hole 31 of the filter element 3, as shown in FIG. 6. The first outer ring portion 11 of the inner ring plate 1 and the second outer ring portion 21 of the outer ring plate 2 can be bonded to the filter element 3 by using, for example, glue, so that the inner ring plate 1, the outer ring plate 2 and the filter element 3 are combined together. In this embodiment, the filter element 3 is provided with a plurality of pleated filter portions 32 arranged in an annular configuration to filter particles and dust in the air flowing through the filter element 3.

Figure 4:
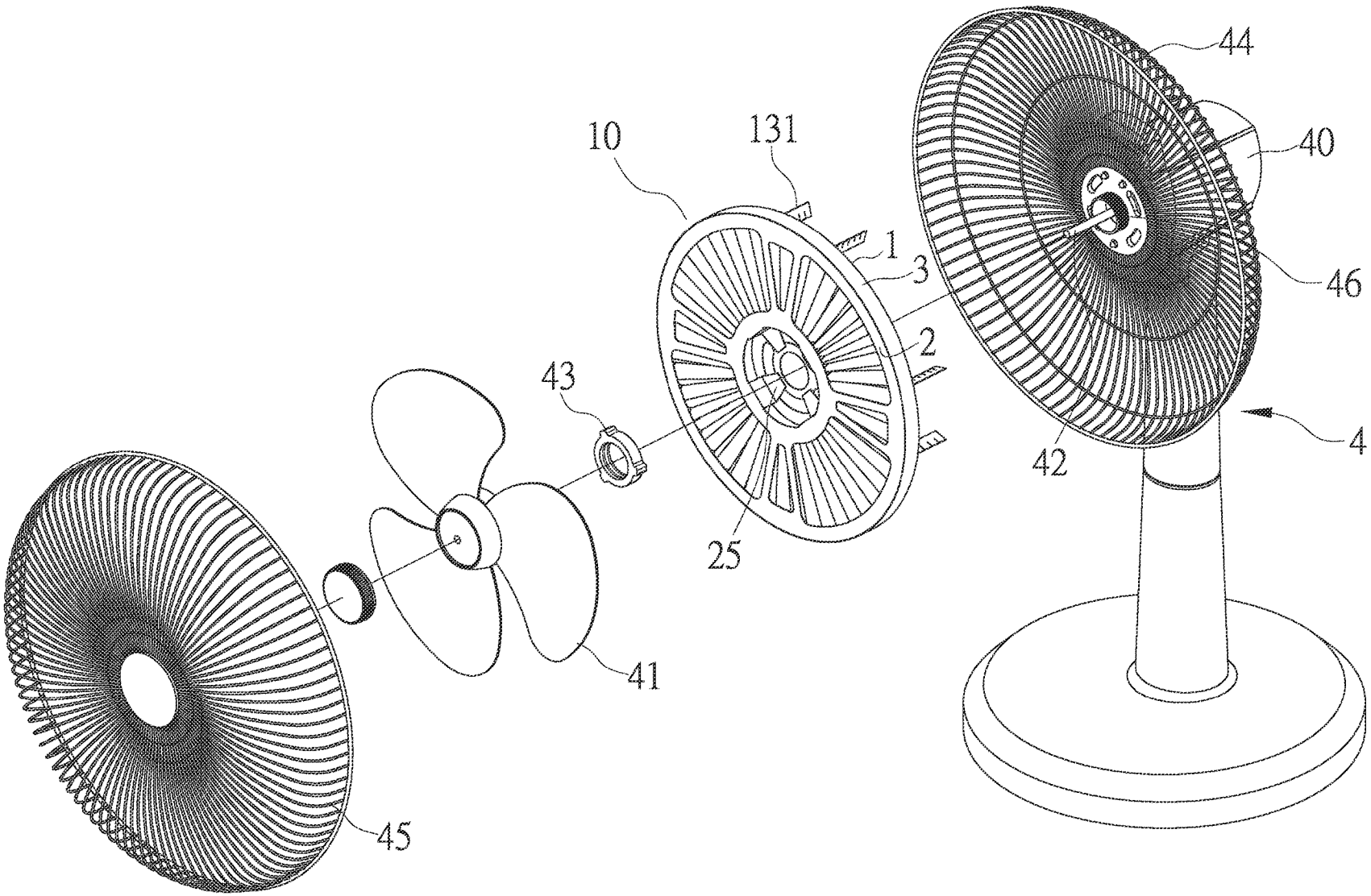
FIG. 4 shows an exploded schematic view of a fan with the filtering device of FIG. 1 installed therein.
Figure 5:
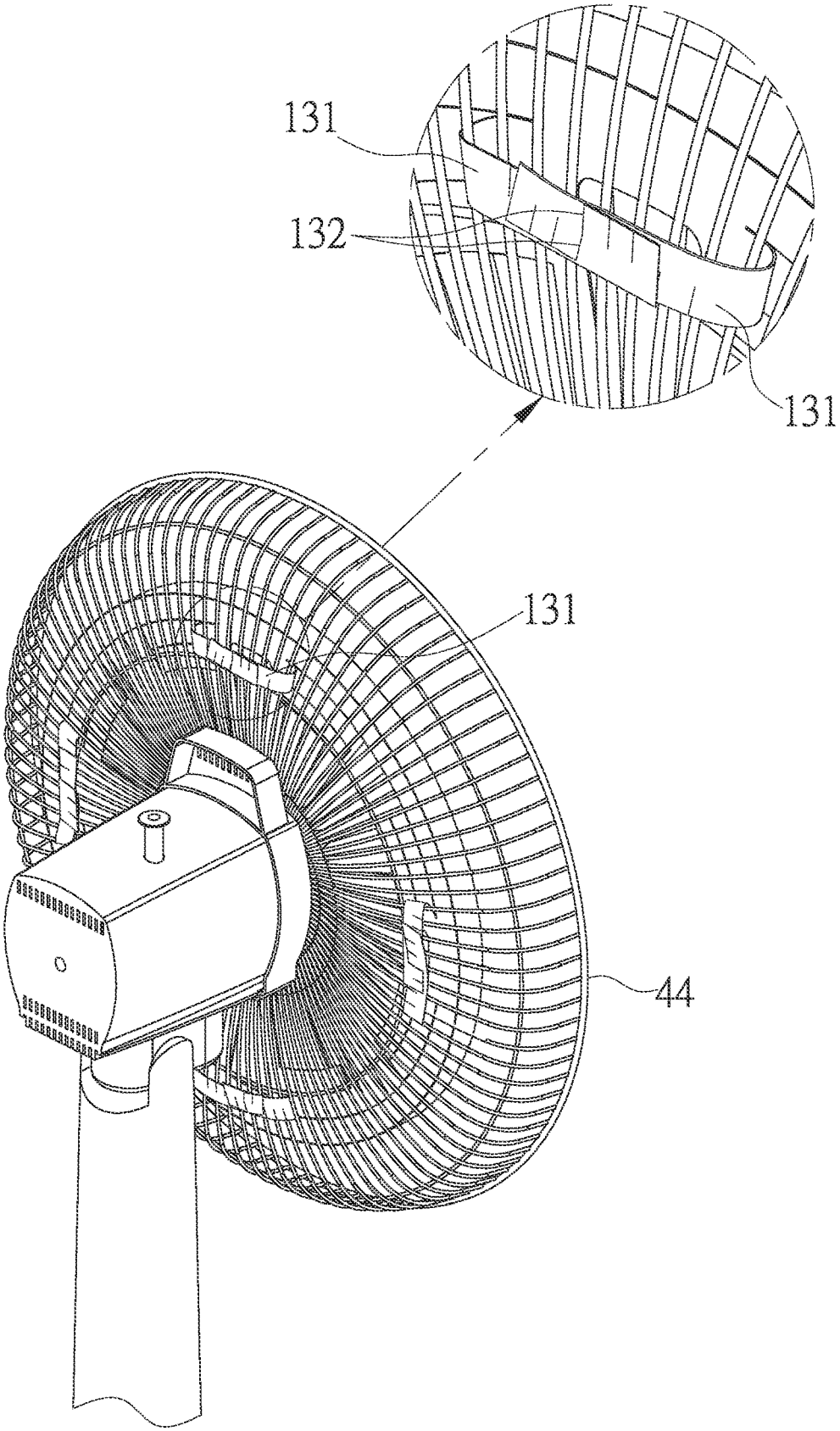
FIG. 5 shows a schematic view of the fixing strips of FIG. 1 in combination with a rear protective grill of the fan of FIG. 4.

As shown in FIG. 4 to FIG. 6, in the assembly of the filtering device 10 of the present invention, the front protective grill 45, the impeller 41, and the rear protective grill locking ring 43 are removed first, and then the rotary shaft 42 is passed through the first shaft hole 14, the through-hole 31 and the second shaft hole 24 of the filtering device 10, so that the support portion 122 of the inner ring plate 1 is sleeved on the mounting base 46, and the second section 253 of the fixing piece 25 of the outer ring plate 2 is attached to the support portion 122 (see FIG. 6). Next, the rear protective grill lock ring 43 is locked on the mounting base 46, so that the support portion 122 of the inner ring plate 1 and the fixing pieces 25 of the outer ring plate 2 are clamped between the rear protective grill 44 and the rear protective grill lock ring 43. Then, the fixing strip 131 are passed through the rear protective grill 44, and two of the cutting lines 132 of two adjacent fixing strips 131 are combined with each other (see FIG. 5), so that the first outer ring portion 11 of the inner ring plate 1 is fixed to the rear protective grill 44. Accordingly, the filtering device 10 of the present invention can be conveniently and stably mounted in the fan 4. In practice, the airflow sent by the rotation of the impeller 41 will pass through the filter element 3 of the filtering device 10, achieving the effect of purifying air.

A filtering device 10 according to a second embodiment of the present invention is shown in FIGS. 7 through 10 of the drawings and is applied to the fan 4. In this embodiment, the inner ring plate 1 and the outer ring plate 2 are preferably made of plastic plates. The first inner ring portion 12 of the inner ring plate 1 is provided with an annular convex portion 15 having a U-shaped section (see FIG. 9), and the convex portion 15 of the inner ring plate 1 is sleeved in the through-hole 31 of the filter element 3. A first peripheral edge 16 extends inwardly from the first outer ring portion 11 of the inner ring plate 1, and a plurality of grooves 161 are formed on the first peripheral edge 16. A second peripheral edge 26 extends outward from the second outer ring portion 21 of the outer ring plate 2, and a plurality of protrusions 261 are arranged on the second peripheral edge 26. The second peripheral edge 26 of the outer ring plate 2 and the first peripheral edge 16 of the inner ring plate 1 are attached to the outer peripheral edge 33 of the filter element 3, and the protrusions 261 are combined with the grooves 161, so that the filter element 3 is firmly combined between the inner ring plate 1 and the outer ring plate 2. Alternatively, the second peripheral edge 26 of the outer ring plate 2 and the first peripheral edge 16 of the inner ring plate 1 can be attached to the outer peripheral edge 33 of the filter element 3 by bonding. The plurality of fixing pieces 25 of the outer ring plate 2 of this embodiment are integrally formed with the outer ring plate 2 and combined together, so that the second shaft hole 24 is defined in the fixing pieces 25 and has an aperture diameter which is approximately equal to that of the first shaft hole 14. Furthermore, the radial dimension defined by the first sections 252 of the fixing pieces 25 is equal to or slightly smaller than the radial dimension of the annular convex portion 15, so that the plurality of fixing pieces of the outer ring plate 2 can fit into the annular convex portion 15 of the inner ring plate 1 (see FIG. 9). Accordingly, the fan filter device 10 of the present invention can be conveniently and firmly installed in the fan 4, thereby improving the service life of the fan filter device 10 of the present invention.

The scope of the invention is to be indicated by the appended claims, rather than by the foregoing description, and all changes which come within the meaning and range of equivalency of the claims are intended to be embraced therein.

The invention claimed is:

1. A filtering device for a fan, the fan including a motor cover, a rotary shaft, an impeller combined at the rotary shaft, and a rear protective grill mounting on a mounting base provided on a front end of the motor cover, with a rear protective grill lock ring locked on the mounting base to fix the rear protective grill, with the filtering device comprising:

an inner ring plate having a first outer ring portion, a first inner ring portion, and a plurality of first connection portions connected between an inner periphery of the first outer ring portion and an outer periphery of the first inner ring portion, with the plurality of first connection portions spaced along a peripheral direction of the inner ring plate, with the first inner ring portion provided with a support portion therein, with the support portion having a first shaft hole therein through which the mounting base extends;

an outer ring plate having a second outer ring portion, a second inner ring portion, and a plurality of second connection portions connected between an inner periphery of the second outer ring portion and an outer periphery of the second inner ring portion, with the plurality of second connection portions spaced along a peripheral direction of the outer ring plate, with the second inner ring portion provided with a second shaft hole therein, with the inner periphery of the second inner ring portion provided with a plurality of fixing pieces extending toward the second shaft hole and spaced along a peripheral direction of the second inner ring portion; and a filter element coupled between the inner ring plate and the outer ring plate and including a through-hole therein, wherein the first shaft hole, the through-hole and the second shaft hole are aligned in an axial direction of the rotary shaft, wherein the rotating shaft is adapted to extend through the first shaft hole, the through-hole and the second shaft hole, wherein the fixing piece of the outer ring plate extends in the through-hole of the filter element and is attached to the support portion of the inner ring plate, so that the support portion of the inner ring plate and the plurality of fixing pieces of the outer ring plate is fixed between the rear protective grill and the rear protective grill lock ring.

2. The filtering device as claimed in claim 1, wherein the first inner ring portion of the inner ring plate is provided with an annular convex portion having a U-shaped section, the convex portion of the inner ring plate is sleeved in the through-hole of the filter element, and the plurality of fixing pieces of the outer ring plate are fitted in the convex portion of the inner ring plate.

3. The filtering device as claimed in claim 1, wherein the fixing piece is L-shaped and includes a first section and a second section, wherein the first section extends along the axial direction of the rotary shaft, and the second section extends along a radial direction of the outer ring plate and is attached to the support portion of the inner ring plate.

4. The filtering device as claimed in claim 1, wherein the first outer ring portion of the inner ring plate and the second outer ring portion of the outer ring plate are combined with the filter element by bonding or adhesion.

5. The filtering device as claimed in claim 1, wherein a first peripheral edge extends inwardly from the first outer ring portion of the inner ring plate, and a second peripheral edge extends outward from the second outer ring portion of the outer ring plate, wherein the second peripheral edge of the outer ring plate and the first peripheral edge of the inner ring plate are attached on an outer peripheral edge of the filter element.

6. The filtering device as claimed in claim 5, wherein a plurality of grooves are formed in the first peripheral edge, and a plurality of protrusions are arranged on the second peripheral edge and combined with the plurality of grooves of the inner ring plate.

7. The filtering device as claimed in claim 1, wherein the filter element is a non-woven fabric filter material containing silver ions.

8. The filtering device as claimed in claim 1, wherein the filter element is provided with a plurality of pleated filter portions in an annular configuration.

9. The filtering device as claimed in claim 1, wherein the inner and outer ring plates are respectively formed of plastic plates.

* * * * *